US010426270B2

(12) United States Patent
Beaulieu

(10) Patent No.: US 10,426,270 B2
(45) Date of Patent: Oct. 1, 2019

(54) FOLDING CHAIR HAVING SUNSHADE

(71) Applicant: Michael Beaulieu, Jacksonville, FL (US)

(72) Inventor: Michael Beaulieu, Jacksonville, FL (US)

( * ) Notice: Subject to any disclaimer, the term of this patent is extended or adjusted under 35 U.S.C. 154(b) by 33 days.

(21) Appl. No.: 15/897,140

(22) Filed: Feb. 14, 2018

(65) Prior Publication Data

US 2018/0228294 A1 Aug. 16, 2018

Related U.S. Application Data

(60) Provisional application No. 62/459,067, filed on Feb. 15, 2017.

(51) Int. Cl.

| | |
|---|---|
| ***A61G 1/04*** | (2006.01) |
| ***A47C 29/00*** | (2006.01) |
| ***A47C 1/14*** | (2006.01) |
| ***A47C 7/66*** | (2006.01) |
| ***A47C 4/28*** | (2006.01) |

(52) U.S. Cl.
CPC ..... *A47C 7/66* (2013.01); *A47C 1/146* (2013.01); *A47C 4/28* (2013.01)

(58) Field of Classification Search
CPC ..... A47C 1/143; A47C 1/035; A47C 4/20; A47C 4/22; A47C 1/024; A47C 7/40; A47C 7/62; A47C 31/11; A47C 1/032; A47C 1/036; A47C 7/02; A47C 13/00; A47C 1/0342; A47C 1/0355; A47C 1/037; A47C 3/20; A47C 4/286; A61G 5/14; A61G 15/002; A61G 5/1059; A61G 5/10; A61G 5/00; A61G 5/006; B62B 9/14
See application file for complete search history.

(56) References Cited

U.S. PATENT DOCUMENTS

| | | | | |
|---|---|---|---|---|
| 4,093,305 A * | 6/1978 | Staroste | A45B 23/00 297/184.17 |
| 4,343,322 A * | 8/1982 | Fiddler | E04F 10/04 135/133 |
| 4,654,907 A * | 4/1987 | Haugaard | A45C 3/10 297/17 |
| 4,921,301 A * | 5/1990 | Haynes | A47C 1/143 297/118 |
| 4,978,166 A * | 12/1990 | James | A47C 7/66 297/184.13 |

(Continued)

*Primary Examiner* — Shin H Kim
(74) *Attorney, Agent, or Firm* — Allen F. Bennett; Bennett Intellectual Property

(57) ABSTRACT

A folding lounge chair includes a seat section and a back section connected by a canopy section. An optional leg extensions section may be pivotally attached to the front of the seat section. The back section includes an adjustable back stand for adjusting the angle of the back section of the chair. The sections are connected to each other by hinge mechanisms that allow the chair to be folded. The panel section includes two lateral attachment straps. U-shaped ribs may be attached to the lateral attachment strips and a canopy may be formed by a canvas extending over the ribs. The canopy may optionally include events to minimize the effect of strong winds. The canopy may also optionally include pockets for storing items. Two shoulder straps on the back of the back section may be used to carry the chair in the folded position.

1 Claim, 4 Drawing Sheets

(56) References Cited

U.S. PATENT DOCUMENTS 5,085,240 A * 2/1992 Littledeer ..... E04H 15/38 135/132
5,246,265 A * 9/1993 Nagan ..... A47C 3/38 297/31
5,655,559 A * 8/1997 Zembik ..... E04H 15/38 135/132
5,882,079 A * 3/1999 Yang ..... A47C 1/146 297/228.1
6,079,777 A * 6/2000 Simmons ..... A47C 1/143 108/157.17
6,478,038 B1 * 11/2002 Le Gette ..... A47G 9/062 135/126
7,118,173 B2 * 10/2006 Kassai ..... B62B 9/14 297/184.13
7,311,355 B2 * 12/2007 Fargason, III ..... A01K 97/01 135/133
7,363,932 B2 * 4/2008 Zheng ..... E04H 15/40 135/117
7,398,612 B2 * 7/2008 Zheng ..... A63B 9/00 135/119
7,832,804 B2 * 11/2010 LaFreniere ..... A47C 1/03 297/31
7,963,596 B2 * 6/2011 Efthimiou ..... A47C 7/66 297/184.1
8,464,379 B1 * 6/2013 Zajac ..... A61G 1/04 5/113
8,851,097 B2 * 10/2014 Vieira ..... A47C 7/66 135/126
9,185,983 B1 * 11/2015 Cohen ..... A47C 4/52
D762,399 S * 8/2016 Sorrick ..... D6/582
2003/0146654 A1 * 8/2003 Nguyen ..... B64D 11/06 297/463.2
2004/0131801 A1 * 7/2004 Wong ..... A01K 1/033 428/12
2005/0125894 A1 * 6/2005 Bandak ..... A47C 1/146 5/418
2006/0054207 A1 * 3/2006 Wootliff ..... A47C 7/66 135/96
2008/0142062 A1 * 6/2008 Carrieri ..... E04H 15/003 135/117
2012/0012144 A1 * 1/2012 Cebular ..... A47C 1/143 135/96
2012/0042920 A1 * 2/2012 Armstrong ..... E04H 15/003 135/153
2013/0214565 A1 * 8/2013 Nickell ..... A47C 1/143 297/30
2016/0120323 A1 * 5/2016 Rivera ..... A47C 7/66 297/184.15
2016/0128318 A1 * 5/2016 Birch ..... A01M 31/02 297/4
2018/0228294 A1 * 8/2018 Beaulieu ..... A47C 1/146

* cited by examiner

FOLDING CHAIR HAVING SUNSHADE

STATEMENT REGARDING FEDERALLY SPONSORED RESEARCH OR DEVELOPMENT

Not Applicable.

THE NAMES OF PARTIES TO A JOINT RESEARCH AGREEMENT

Not Applicable

INCORPORATION-BY-REFERENCE OF THE MATERIAL SUBMITTED ON A COMPACT DISC

Not Applicable.

BACKGROUND OF THE INVENTION

Field of the Invention

The present invention relates to a folding portable lounge chair having a sunshade. More particularly, the invention relates to a lightweight folding lounge chair having a sunshade that is simple to operate and durable.

Description of the Related Art

Folding lounge chairs have become commonplace and are frequently used at the beach, near a pool, in a park, while camping and elsewhere. They are a convenient means for providing comfortable recumbence an almost any location. More recently, folding, portable lounge chairs have also been designed to include a sunshade or canopy for preventing overexposure to the sun and protection in rain. Unfortunately, most lounge chairs, particularly ones including a shading system, are unwieldy and overly cumbersome. They include several moving mechanisms, which are prone to breaking and if a user is not careful can lead to pinching between different components.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide a lightweight, portable lounge chair having a sunshade that is simple to operate, durable and reliable.

BRIEF SUMMARY OF THE INVENTION

Disclosed is a portable, foldable and easily carried lounge chair having an accordion type canopy. In one embodiment. A folding lounge chair comprises a rectangular seat section having a frame of two transverse rods separated by two parallel coextensive longitudinal rods and a pliant panel extending across the frame. A leg extension section has a rectangular frame rotatably attached to the rectangular seat section by one or more hinges. A back section has a rectangular frame having to parallel coextensive longitudinal rods and a distal transverse rod, with a pliant panel of material extending over the frame. A panel section having to coextensive lateral longitudinal rods and a panel of pliant material extending between them, the panel section being located between and pivotally attached to the seat section and the back section. A stand affixed to the back of the back section that allows adjustments of the position of the back section relative to the panel section. A canopy having a campus extending over five ribs, the ribs being joined to straps on both of the longitudinal rods of the panel section and capable of being spread over at least a portion of the back section, the panel section and the seat section. Two shoulder straps are located on the back of the back section.

It is therefore an object of the present invention to provide a portable lounge chair having a canopy.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE SEVERAL VIEWS OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
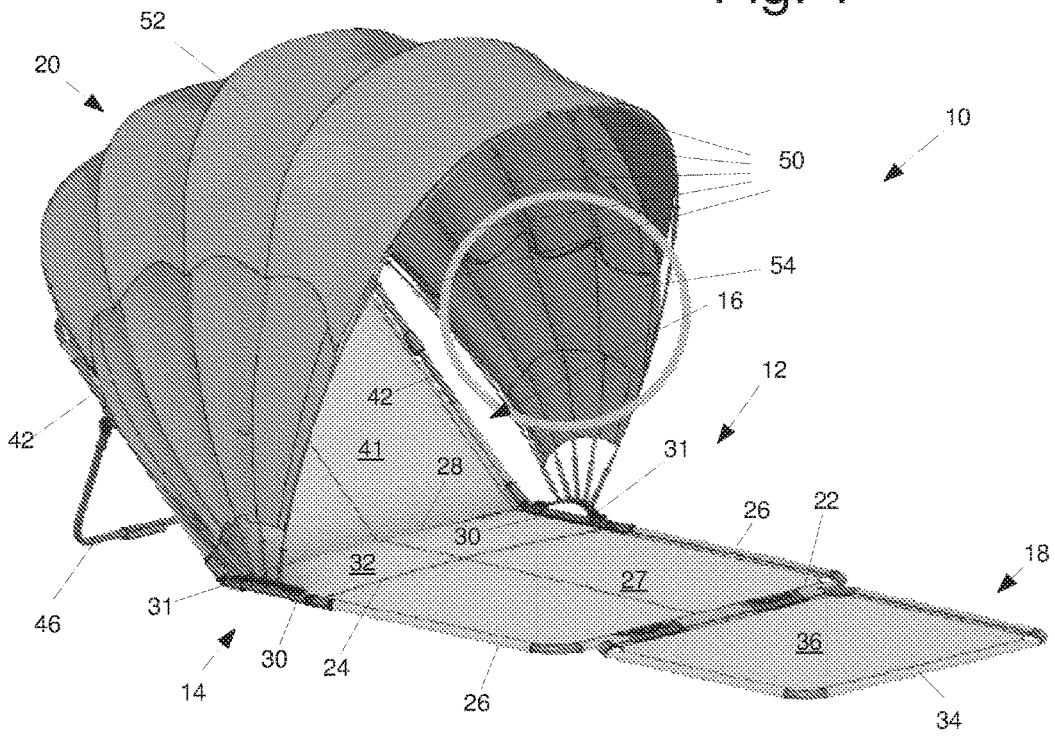
FIG. 1 is a perspective view of a folding lounge chair in accordance with the principles of the invention.
Figure 2:
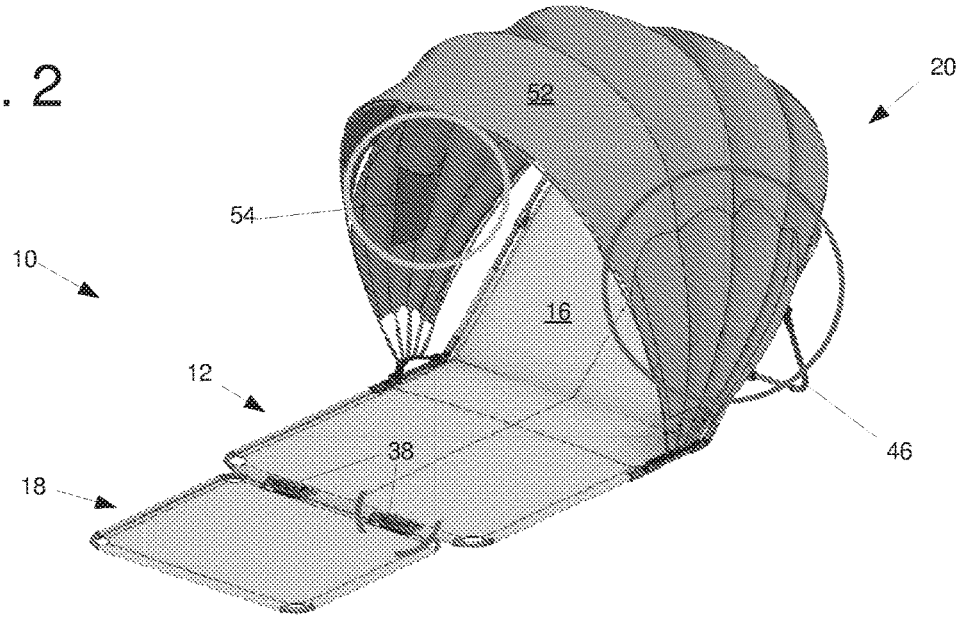
FIG. 2 is another perspective view of a folding lounge chair in accordance with the principles of the invention.
Figure 3:
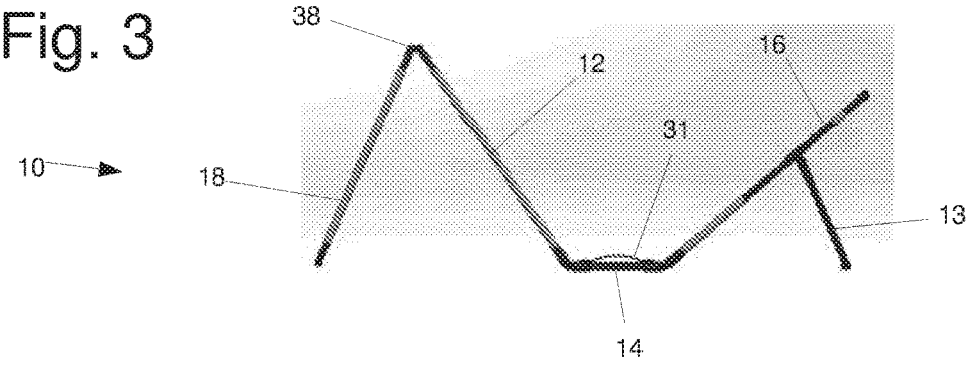
FIG. 3 is a side view of a folding lounge chair with the canopy detached in accordance with the principles of the invention.
Figure 4:
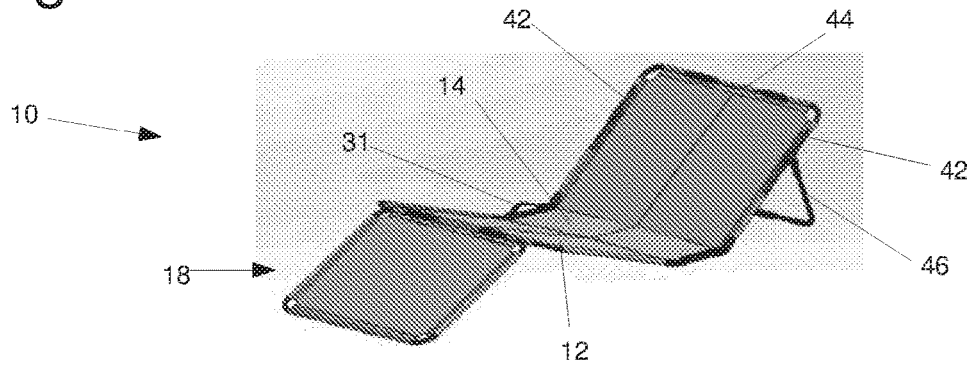
FIG. 4 is a side perspective view of a folding lounge chair with the canopy detached in accordance with the principles of the invention.
Figure 5:
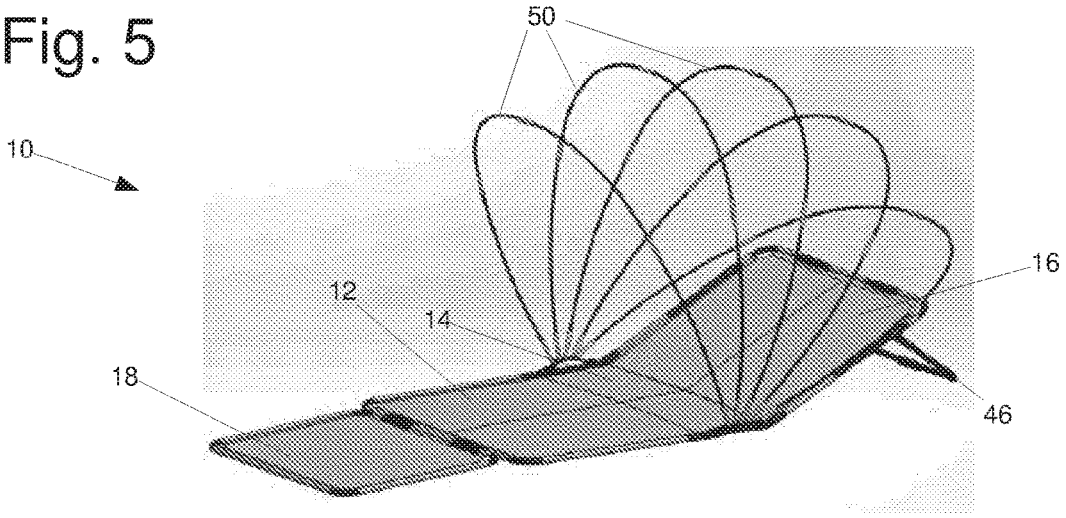
FIG. 5 is a side perspective view of a folding lounge chair with the ribs of the canopy but not the canvas in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Disclosed is a folding lounge chair having a canopy. The canopy is extremely lightweight due to its use of flexible poles such as those used in tents to form a plurality of ribs extending over the chair. A flexible, folding material extends over the ribs to form a canopy. The lounge chair may be readily folded for rapid and efficient portability. The flexible ribs may optionally be detached from the lounge chair and stored separately. The lounge chair includes a back support stand mechanism and a leg extension. A lightweight frame is used, and a pliant material is stretched over the frame to provide a durable lounge chair.

FIG. 1 shows a folding lounge chair 10 in accordance with the principles of the invention. The folding lounge chair 10 includes a seat section 12, canopy section 14, a back section 16, a leg extension section 18 and a canopy 20. Each section consists of a pliant material stretched over a rectangular frame. The seat section 12 has a frame formed by a distal transverse rod 22 separated from a proximal transverse rod 24 by two lateral longitudinal rods 26. A panel 27 of pliant material extends between the rods. The canopy section 14 similarly includes a transverse rod 28 separated from the medial transverse rod 24 by two lateral longitudinal canopy support rods 30, with a panel 32 of pliant material stretched between the rods. In this embodiment, the seat section 12 and the canopy section 14 share the medial transverse rod 24. Each of the two lateral longitudinal canopy support rods 30 include a semi rigid support strap 31 to which a canopy 20 is attached.

The leg extension section 18 has a rectangular frame 34 supporting a panel 36 of a pliant material. Additional pockets can be added to the leg extensions section 18. The leg extensions section 18 is attached to the seat section 12 by two hinges 38 that allow the leg section 18 to pivot 3600. The back section 16 has a rectangular frame having two longitudinal lateral rods 42 connecting a distal transverse rod 44 and the transverse rod 28, which it shares with the canopy section 14. A panel 41 of pliant material extends between the rods of the back section 16. The back section 16 also includes a support stand 46 that may be adjusted to adjust the angle of the back section 16 relative to the canopy section 14 and the seat section 12.

The canopy 20 of this embodiment is comprised of five flexible ribs 50 supporting a canvas 52 extending across them. One or more pockets 54 may be formed on the inside of the canvas 52 to provide storage spaces. The canvas 52 may also include one or more events to minimize the effect of strong winds on the canopy 20. Each of the ribs connects to both of the straps 31.

Figure 6:
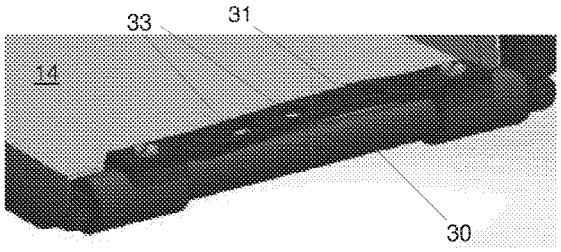
FIG. 6 is an enlarged view of the attachment strips of a folding lounge chair in accordance with the principles of the invention.
Figure 7:
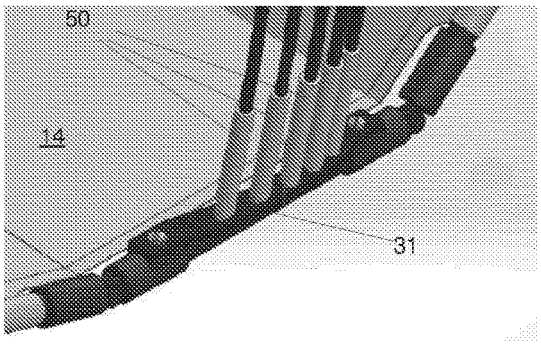
FIG. 7 is an enlarged view of the attachment strips having the ribs connected of a folding lounge chair in accordance with principles of the invention.

FIGS. 6 and 7 show the strap 31 and the ribs 50 in more detail. The strap 31 includes a socket 33 for each of the ribs 50. The ends of the ribs 50 are configured to attach to the sockets 33. They may snap in the place by means of a detent, or may optionally use a bayonet lock, detent, R-clip, or other mechanism for rapidly attaching and detaching.

Figure 8:
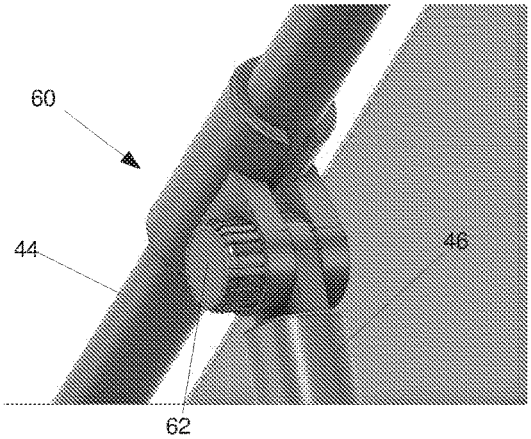
FIG. 8 is an enlarged view of a hinge for adjusting the back stand of a folding lounge chair in accordance with the principles of the invention.
Figure 9:
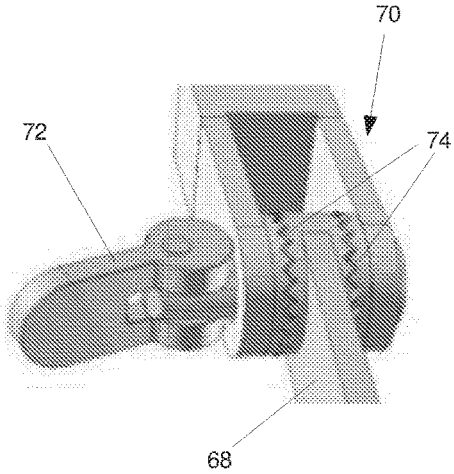
FIG. 9 is an alternative embodiment of a hinge for adjusting the back stand of a folding lounge chair in accordance with the principles of the invention.

FIG. 8 shows a joint 60 attaching the back section stand 46 to one of the lateral rods 44 of the back section. The joint 60 includes a knob 62 that may be loosens in order to adjust the position of the back stand 46. The knob 62 is tightened when the stand 46 is in a desired position. FIG. 9 shows an alternative embodiment of a joint 70 for adjusting the position of the back stand 68. The joint 70 may be affixed to the back section of a folding lounge chair. It includes a cam lock 72 for engaging ratchet gears 74, thereby holding the back stand 68 in a desired position.

Figure 10:
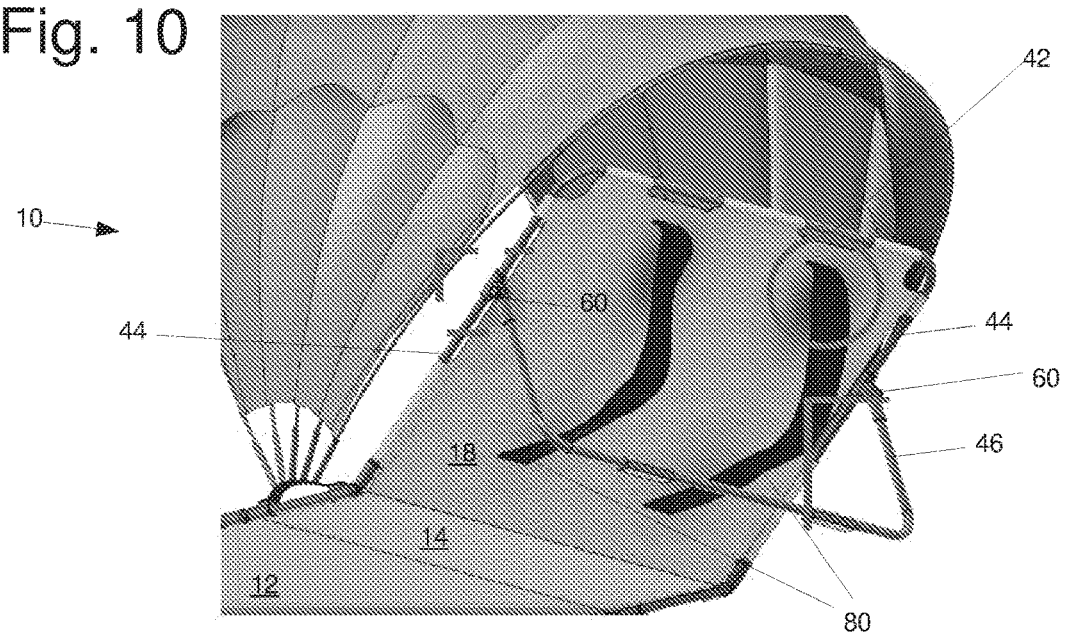
FIG. 10 is a rear perspective view of the back panel and shoulder straps of a folding lounge chair in accordance with the principles of the invention.

FIG. 10 shows the back side of the panel section 18 having to shoulder straps 80. The shoulder straps 80 may be adjustable and allow a person to carry the chair 10 on his or her back when transporting the chair to a new location.

Figure 11:
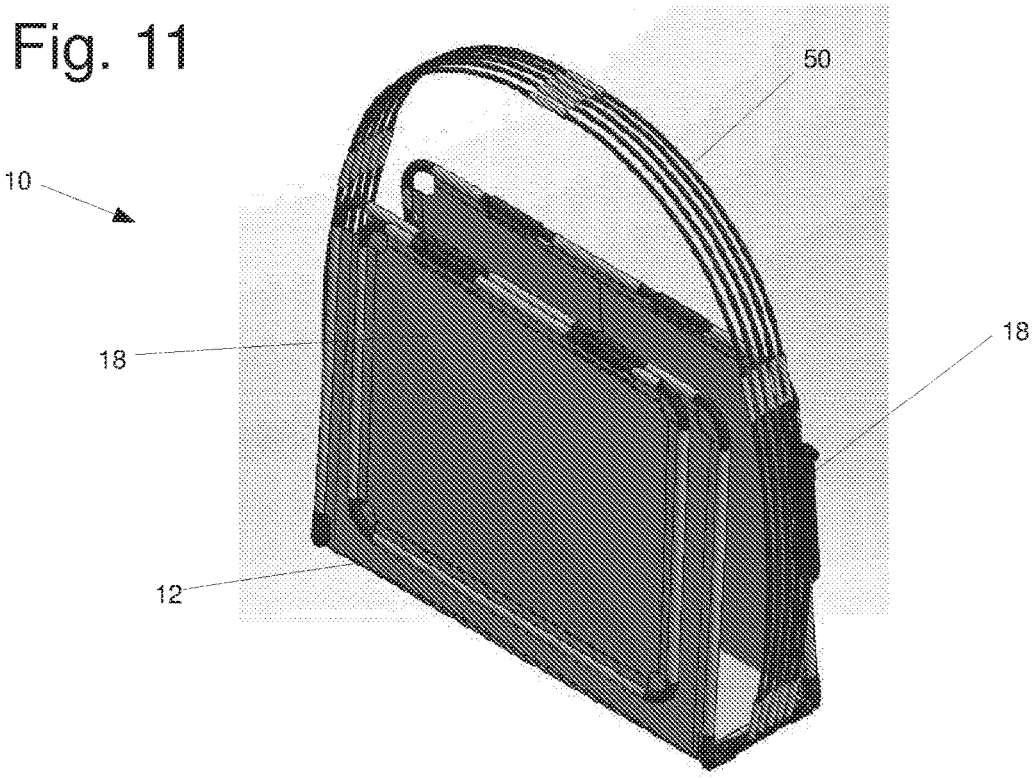
FIG. 11 is a perspective view of a folding lounge chair in the folded configuration in accordance with the principles of the invention.

FIG. 11 shows the folding chair 10 in the folded position. The leg extensions section 18, the seats section 12, and the back section 18 are all folded such that they are flush and parallel. The canopy section 14 is perpendicular to the other sections of the chair 10 while the ribs 50 extending up from straps 31 on the panel section 14 are also substantially parallel to the seat section 12, the back section 16 and the leg extensions section 18. The chair may optionally include straps or bungee cords to hold the chair in the folded position during transport. The chair may optionally be fabricated from sustainable resources such as plant/hemp fibers as well as metals and plastics.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A folding lounge chair comprising:

a rectangular seat section having a frame of two transverse rods separated by two parallel coextensive longitudinal rods and a pliant panel extending across the frame;

a leg extensions section having a rectangular frame rotatably attached to the rectangular seat section by one or more hinges;

a back section having a rectangular frame having to parallel coextensive longitudinal rods and a distal transverse rod, with a pliant panel of material extending over the frame;

a panel section having to coextensive lateral longitudinal rods and a panel of pliant material extending between them, the panel section being located between and pivotally attached to the seat section and the back section;

a stand affixed to the back of the back section that allows adjustments of the position of the back section relative to the panel section;

a canopy having a campus extending over five ribs, the ribs being joined to straps on both of the longitudinal rods of the panel section and capable of being spread over at least a portion of the back section, the panel section and the seat section;

two shoulder straps on the back of the back section.

* * * * *